US008485106B2

(12) United States Patent
Thyssen, Jr.

(10) Patent No.: US 8,485,106 B2
(45) Date of Patent: Jul. 16, 2013

(54) STOP DEVICE FOR RAIL CARS AND IN PARTICULAR FOR USE WITH TRACKS IN CLASSIFICATION YARDS

(75) Inventor: Cornelius Johannes Thyssen, Jr., Sinembe Park (ZA)

(73) Assignee: Argent Industrial Limited, Sinembe Park (ZA)

( * ) Notice: Subject to any disclaimer, the term of this patent is extended or adjusted under 35 U.S.C. 154(b) by 0 days.

(21) Appl. No.: 13/112,451

(22) Filed: May 20, 2011

(65) Prior Publication Data

US 2012/0012027 A1 Jan. 19, 2012

Related U.S. Application Data

(60) Provisional application No. 61/346,714, filed on May 20, 2010.

(51) Int. Cl.
*B61K 7/00* (2006.01)

(52) U.S. Cl.
USPC ..... 104/249; 104/257; 104/259

(58) Field of Classification Search
USPC ..... 104/249–260
See application file for complete search history.

(56) References Cited

U.S. PATENT DOCUMENTS

| | | | | | |
|---|---|---|---|---|---|
| 2,175,286 | A * | 10/1939 | Finch | 104/257 |
| 2,945,454 | A * | 7/1960 | Beck | 104/259 |
| 3,215,091 | A * | 11/1965 | Hayes | 104/259 |
| 3,828,688 | A * | 8/1974 | Bradbury | 104/252 |
| 4,080,904 | A * | 3/1978 | Lofink et al. | 104/162 |
| 4,216,724 | A * | 8/1980 | Grillet | 104/258 |
| 4,739,863 | A * | 4/1988 | Stauffer | 188/32 |
| 6,152,042 | A * | 11/2000 | Barry et al. | 104/26.2 |
| 6,155,178 | A * | 12/2000 | Pease | 104/258 |
| 6,773,221 | B2 * | 8/2004 | Belongia et al. | 414/401 |
| 7,717,043 | B2 * | 5/2010 | Rastegar et al. | 104/26.2 |
| 8,020,494 | B2 * | 9/2011 | Smith et al. | 104/250 |
| 8,079,309 | B2 * | 12/2011 | Heyden et al. | 104/249 |
| 2009/0031914 | A1 * | 2/2009 | Hahn et al. | 104/249 |
| 2010/0083865 | A1 * | 4/2010 | Heyden et al. | 104/249 |
| 2011/0120340 | A1 * | 5/2011 | Smith et al. | 104/249 |
| 2011/0232521 | A1 * | 9/2011 | Heyden et al. | 104/249 |
| 2011/0265679 | A1 * | 11/2011 | Smith et al. | 104/53 |
| 2012/0012027 | A1 * | 1/2012 | Thyssen, Jr. | 104/259 |

* cited by examiner

*Primary Examiner* — Jason C Smith
(74) *Attorney, Agent, or Firm* — Young & Thompson

(57) ABSTRACT

A device for stopping rail cards includes an articulated member adapted to move between a first raised position in which ait receives a rail car wheel in contacting or abutting relationship to cause effective stopping of the car, and a second retracted position which offers no resistance to movement of the car wheels. A hydraulic or pneumatic ram is provided to move the articulated member between the two positions.

24 Claims, 6 Drawing Sheets

STOP DEVICE FOR RAIL CARS AND IN PARTICULAR FOR USE WITH TRACKS IN CLASSIFICATION YARDS

BACKGROUND OF THE INVENTION

1. Field of the Invention

This invention relates to a dynamic stopping device for rail cars and in particular for use with tracks in classification yards to prevent run out of rail cars at the end of the classification tracks, due to lack of gradient or speed control in these particular tracks.

2. Description of the Related Art

A problem encountered in classification yards is the tendency of cars to "creep" or "run out" and thereby compromise the efficiency of the processes of the yard, and can even constitute a danger by leaving the track, fouling switches and other tracks in the process, if not effectively stopped. Run out occurs when the car's speed is not properly controlled by sufficient inclined gradients at the end of classification tracks, or due to the lack of retarder speed control. The cars can also be pushed out through the track due to the impact from other cars continuously coupling to the first cars in the train.

An early device is described in GB424517 (1935 to John Mitchell) for preventing cars from running backwards down an incline. A catch is pivoted in a sunken casing and is maintained in a projecting position to stop cars travelling in one direction but allowing cars or other vehicles from travelling in the opposite direction by virtue of the catch being displaceable by cars in the opposite direction. This arrangement is somewhat crude and will have limited, if any, use in classification yards, mainly because contact of a car wheel or axle with the catch may result in a violent impact.

Another prior art device is described in GB859757 (1961 to Hobbs et al) includes a similar catch or arm acting against a ram for stopping and checking individual rail vehicles such as mine cars.

It is an object of the present invention to provide a stop device which is not only useful for slowing down and stopping rail cars generally but has also particular utility in situations such as classification yards.

BRIEF SUMMARY OF THE INVENTION

According to the invention a device for stopping rail cars includes an articulated member adapted to move between a first raised position in which it receives a car wheel in contacting or abutting relationship causing effective stopping of the car, and a second retracted position which offers no resistance to movement of car wheels, movement between the two positions being effected by means of a hydraulic or pneumatic ram.

In a preferred form of the invention the articulated member includes a bifurcated linkage assembly, the free ends of which are movable by means of the ram—the ends being in sliding relationship and may be mounted on a shaft or the like for this purpose. The shafts can also be substituted with rollers running on the base in guide rails, or can be made to slide on a base similar to a machine saddle sliding on a machine base. The slides will induce some additional friction to aid the stopping.

The linkage assembly may be associated with hydraulic cylinders or the like energy-absorbing means that resist and stop the movement of the car when the linkage assembly is in its raised position for the car wheel/s to contact.

A pair of linkage assemblies may be provided, one corresponding to each rail, and the term "device" is intended to refer to a pair of devices.

The linkage assemblies or arms may be mounted on slides which are slidable on shafts The device is adapted to slow down and stop a first car and to resist most of the energy resulting from the remainder of the cars that are added for coupling to the line. This is effected by the hydraulic cylinders which provide a constant resisting force as the device slows down the rail car to zero. Once the train has been constituted the linkage assembly is lowered to permit the train to be pulled from the classification track.

It is important that the device is adapted to allow coupling between a locomotive and the first car. During the coupling operation tension builds up between the device and the line of cars pushing against each other and this tension needs to be overcome by the locomotive—if the tension is not balanced when the device is in its retracted position, the first car will be pushed forwards and can constitute a danger.

It might be required to arrest the car on the device through contacting the coupler on the car and not the wheels, in which case linkage mechanisms may have to be provided that are adapted to reach about 34.5" above the rail to contact the rail car on the car coupler. In this configuration the coupler is on the point of contact and the locomotive may not be able to couple so that additional means of raising and retracting will have to be implemented. In this case the car will have to be arrested in place while the linkage assembly is lowered and, when coupled to the locomotive the arrestor devices can be released in order for the locomotive to take up the tension. In this event an additional arrestor system may be added to keep the rail car in position during the lowering of the device to resist the tension and keep the car from "jumping" forward. The arrestor system may be biased to the front and/or rear of the wheel to maintain the car in place.

The bifurcated linkage assembly may include anti-friction rollers to prevent the car wheels trying to "climb" on to the device.

The hydraulic cylinders may be provided with internal springs that tend to return the slides to their original position once the tension is released.

The resistive force can be changed by changing the hydraulic cylinders with respect to cylinder diameter and/or stroke length.

It may be necessary to include retarders downstream of the devices in order to reduce the incoming speed of the first (and any succeeding) car/s prior to contact with the device. Such retarders may be adapted to reduce speed to zero if required. Speed reducing devices include piston type hydraulic retarders as well as clasp or inert type retarders.

It will be appreciated that the device acts as a positive stop with the added ability of reducing speed by applying a constant resistive force, over a predetermined distance that will reduce any impact and protect the cargo in the car.

BRIEF DESCRIPTION OF THE DRAWINGS

An embodiment of the invention is described below with reference to the accompanying drawings, in which.

DETAILED DESCRIPTION OF THE PREFERRED EMBODIMENTS

Figure 1:
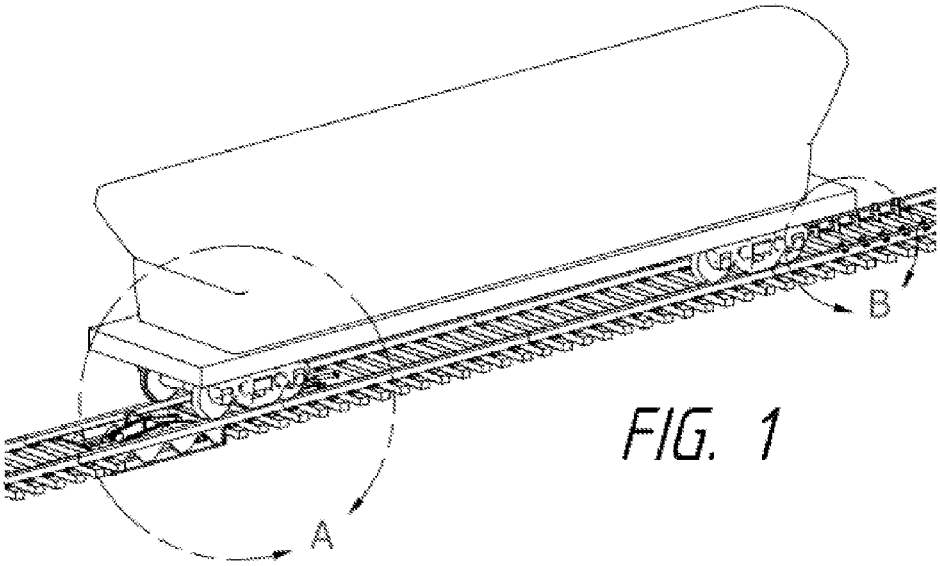
FIG. 1 is an isometric view of a first car about to engage the device of the invention.
Figure 2:
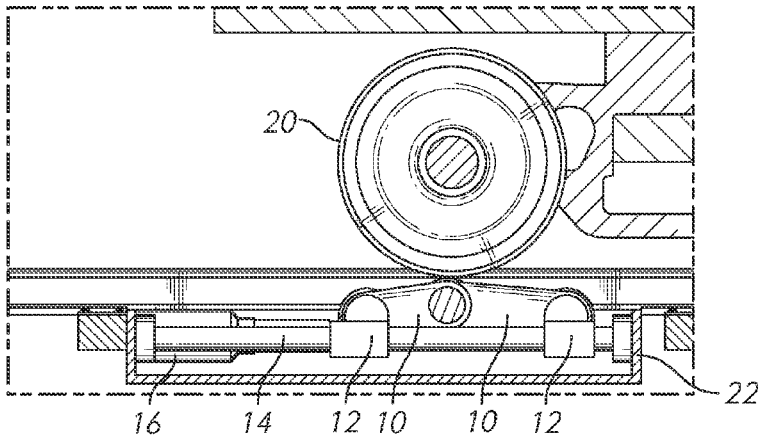
FIG. 2 is side view of the device in its retracted opposition.
Figure 3:
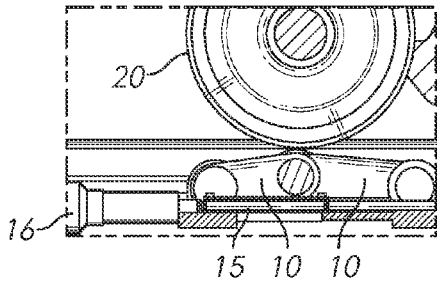
FIG. 3 is a detailed view of FIG. 2.
Figure 4:
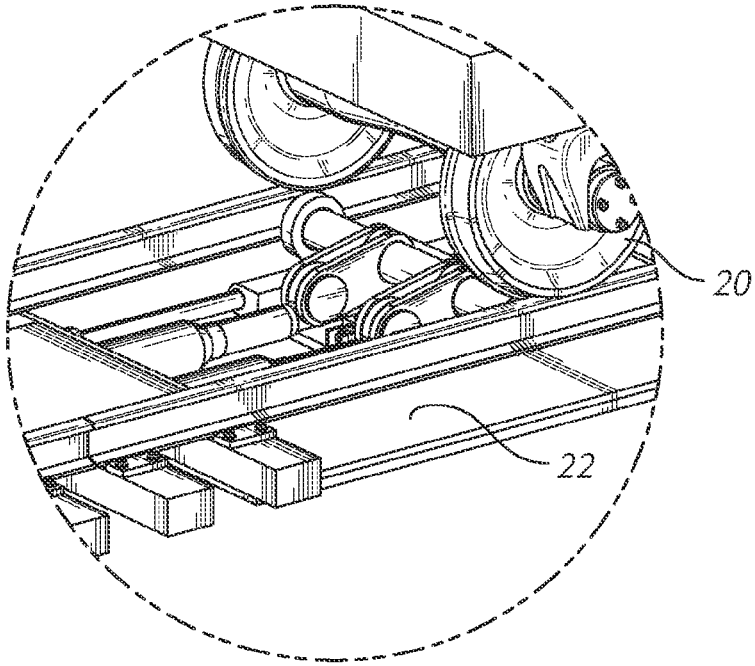
FIG. 4 is an isometric view of FIG. 2.
Figure 5:
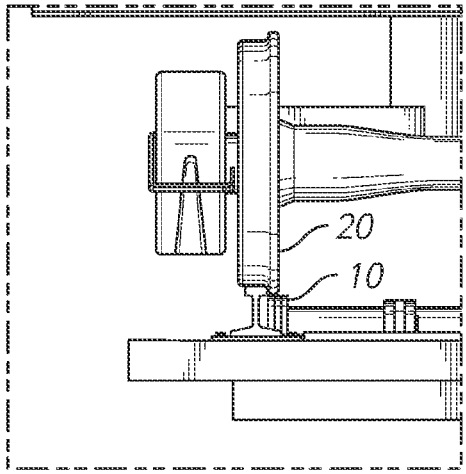
FIG. 5 is a rear view of the wheel of a car in the retracted position of the device.

The device of the invention includes an assembly of a pair of bifurcated articulated arms constituting a linkage assembly 10 attached to slides 12 slidable on shafts 14, the slides being activated by rams 15.

A pair of hydraulic cylinders 16 provide a resistive force as described and explained above.

In FIGS. 2 to 5 the arms are in their retracted position, allowing the wheels 20 of cars or other vehicles freely to pass over the device.

The device is contained in a casing 22 under the rails.

Figure 6:
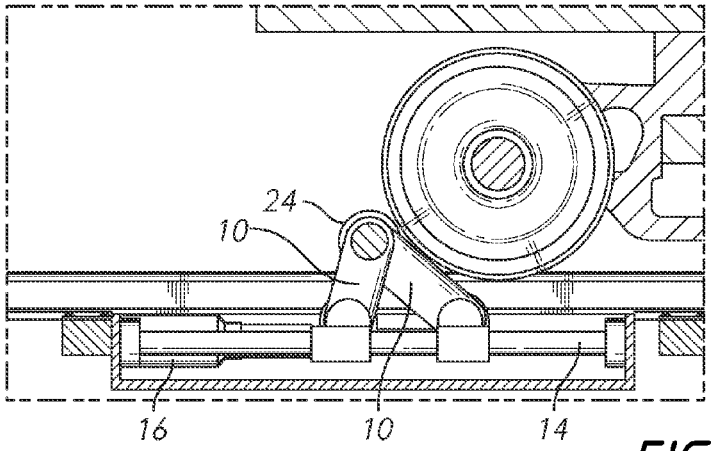
FIG. 6 is a view similar to that of FIG. 2 in which the device is in the raised position.
Figure 7:
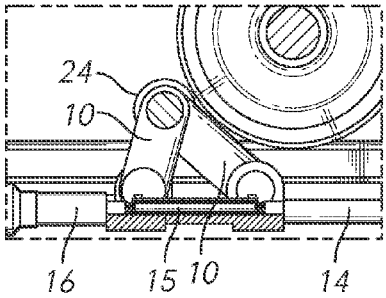
FIG. 7 is a detailed view of FIG. 6.
Figure 8:
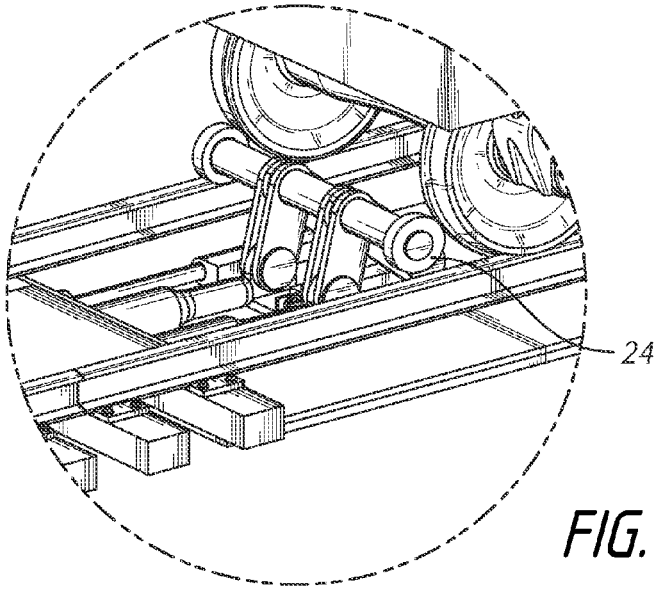
FIG. 8 is an isometric view of FIG. 6.

In FIGS. 6 to 8 the arms have been moved into an elevated position by means of the ram 15 just prior to contact. Frictionless rollers 24 are provided at the elbows of the arms so that the wheels do not "climb".

Figure 9:
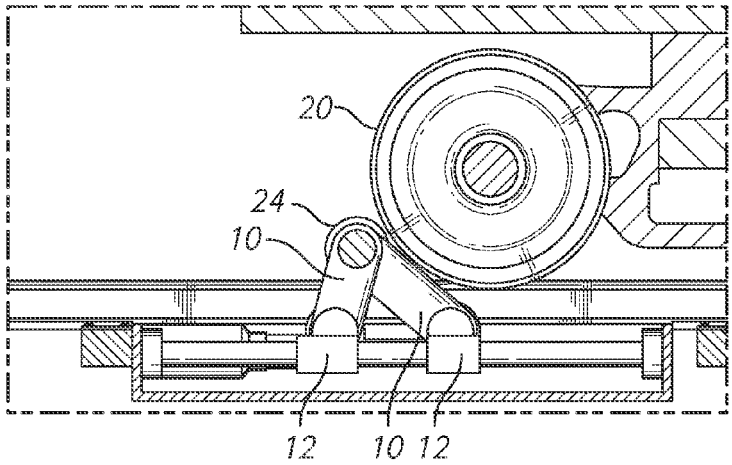
FIG. 9 is a view similar to that of FIG. 6 in which the device is activated into its raised position; and the device stroked forward under the car's load (in this respect please note that reference 16 is in a compressed condition compared with its position in FIG. 6)
Figure 10:
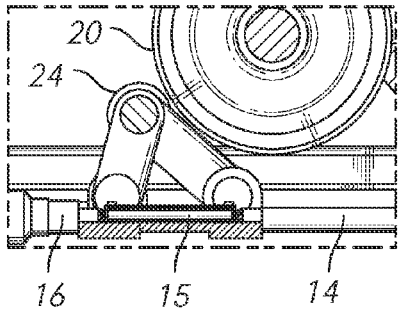
FIG. 10 is a detailed view of FIG. 9.
Figure 11:
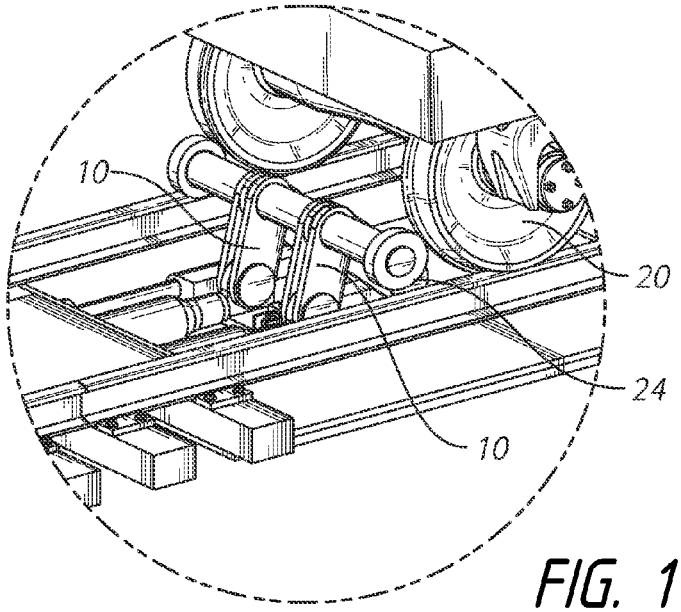
FIG. 11 is an isometric view of FIG. 9.
Figure 12:
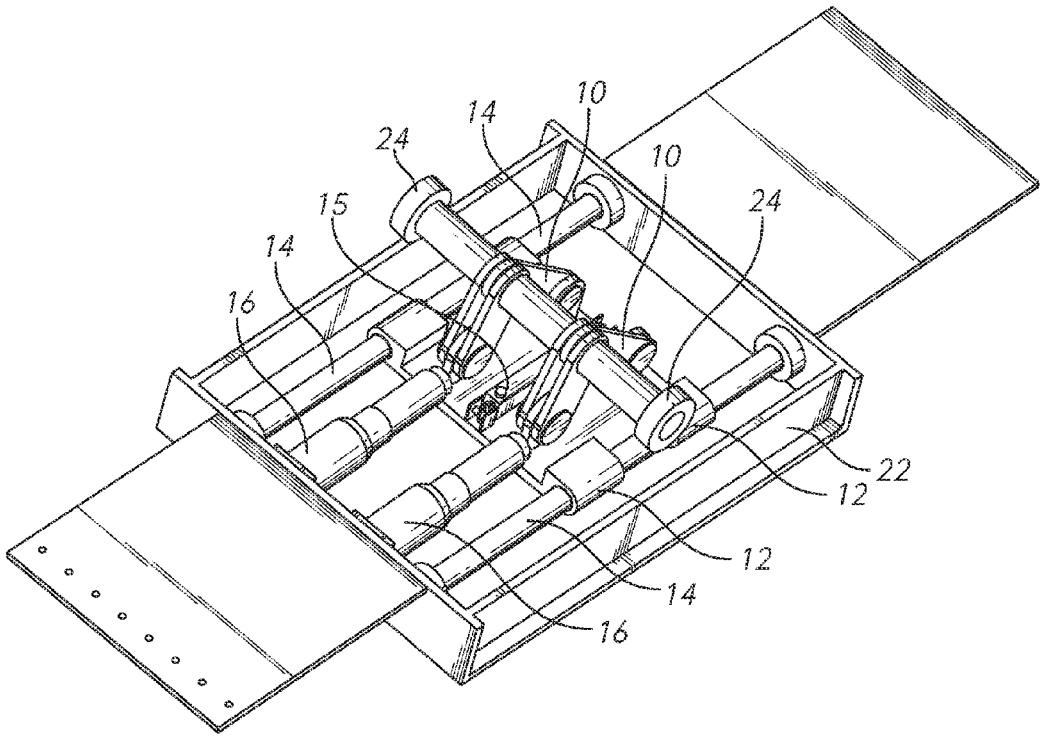
FIG. 12 is an isometric view of the device by itself.

In FIGS. 9 to 11 the rams have activated the arms so that the classification operation can commence.

Figure 13:
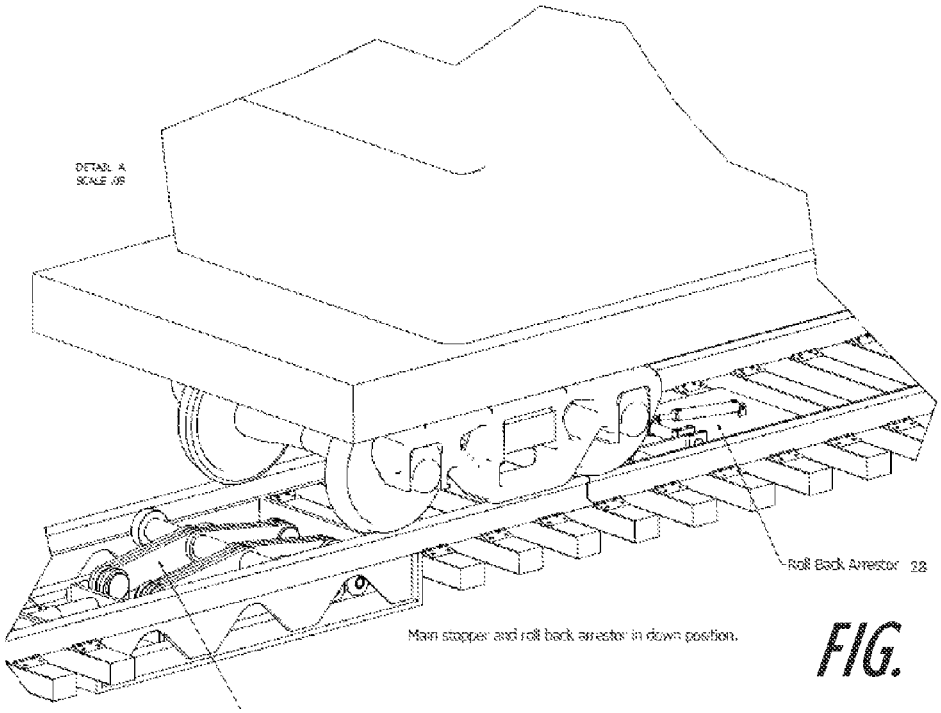
FIG. 13 is an isometric view of the wheel of the car with both the device and the arrestor in the retracted position.

Referring to FIG. 13, and because the nature of a classification yard means that the rail track is on an incline, there might be a tendency for the car to roll back down the incline after contact with the stopper. For this reason, a roll back arrestor 28 is added to keep the car's front wheel set close to the device, and prevent the car from rolling back down the incline due to gravity.

Figure 14:
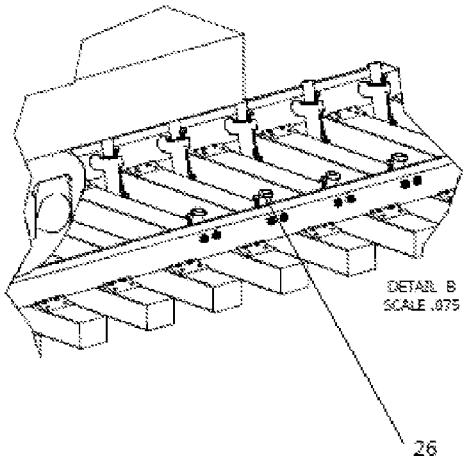
FIG. 14 is a view of the joule piston retarders.

Referring to FIG. 14, Joule piston retarders 26 are used as a safety to ensure that cars arrive at the stopper at the 4 mph, or higher speed, depending on the chosen capability of the device. If the track's gradient is not sufficient to slow the cars down to the desired speed prior to contacting the device, the Joule retarders 26 will have to be installed. The Joule piston retarder's 26 position and quantity will depend on the gradient, and car speeds, as field tested for every track.

In some arrangements, speed retarders 26 are provided downstream of the device in order to reduce incoming speed of a first car and any succeeding cars prior to contact with the device. In some arrangements, the speed retarders 26 are adapted to reduce speed to zero if required. In some arrangements, the speed retarders 26 comprise piston-type hydraulic retarders 26. In some arrangements, the speed retarders 26 comprise clasp type retarders 26. In some arrangements, the speed retarders 26 comprise inert type retarders 26.

The invention claimed is:

1. A device for slowing down/retarding and stopping rail cars comprising:

an articulated member adapted to move between (i) a first raised position wherein the articulated member is constructed and arranged to receive and dynamically resist motion of a car wheel in contacting or abutting relationship causing effective dampened slowing down and stopping of the cars over an extended distance, and (ii) a second retracted position wherein the articulated member offers no resistance to movement of the car wheel, movement between the two positions being effected via a hydraulic or pneumatic ram.

2. The device according to claim 1 in which the articulated member includes a bifurcated linkage assembly, free ends of the bifurcated linkage assembly being movable via the hydraulic or pneumatic ram, each of the free ends being in sliding relationship and mountable on a shaft.

3. The device according to claim 2 in which each shaft is made to slide on a base similar to a machine saddle sliding on a machine base, the slides inducing additional friction to aid slowing down and stopping of the rail car.

4. The device according to claim 2 in which the linkage assembly is associated with hydraulic cylinders or similar means for energy-absorbing that resist and slow movement of the car to a stop when the linkage assembly is in the raised position for the car wheel to contact.

5. The device according to claim 4 in which the hydraulic cylinders are provided with internal springs that bias slides to an original position once the tension is released.

6. The device according to claim 4 in which resistive force offered by the hydraulic cylinders is able to be varied by changing the hydraulic cylinders with respect to at least one of cylinder diameter and stroke length.

7. The device according to claim 2 in which a pair of linkage assemblies is provided, one corresponding to each of a set of rails.

8. The device according to claim 2 in which the bifurcated linkage assembly includes antifriction rollers to prevent the forward momentum of the car from causing the wheels trying to mount the device.

9. The device according to claim 1 in which the articulated member includes a bifurcated linkage assembly, free ends of the bifurcated linkage assembly being movable via the hydraulic or pneumatic ram, each of the free ends being in sliding relationship and mountable on rollers running in a base on guide rails.

10. The device according to claim 1 which is adapted to stop a first car of the cars and to resist most energy resulting from a remainder of the cars that are added for coupling to a line, the hydraulic cylinders providing a constant resisting force as the device slows down the rail car to zero.

11. The device according to claim 10 in which the linkage assembly is lowered to permit the rail cars to be pulled from a classification track once the train has been constituted.

12. The device according to claim 10 which permits coupling between a locomotive and the first car.

13. The device according to claim 1 in which speed retarders are provided downstream of the device in order to reduce incoming speed of a first car and any succeeding cars prior to contact with the device.

14. The device according to claim 13 in which the speed retarders are adapted to reduce speed to zero if required.

15. The device according to claim 13 in which speed retarders comprise piston-type hydraulic retarders.

16. The device according to claim 13 in which speed retarders comprise clasp type retarders.

17. The device according to claim 13 in which speed retarders comprise inert type retarders.

18. The device according to claim 1:

wherein the articulated member includes antifriction rollers;

wherein the antifriction rollers are constructed to engage the car wheel;

wherein when the antifriction rollers engage the car wheel, rotation of the car wheel in a first direction induces rotation of the antifriction rollers in a second direction opposite to the first direction to prevent the car wheel from rolling over and overcoming the articulated member.

19. The device according to claim 1, wherein the articulated member, when in the first raised position, is constructed and arranged to be in the contacting or abutting relationship with a flange of the car wheel and not a tyre of the car wheel.

20. The device according to claim 1, wherein the articulated member, when in the first raised position, is constructed and arranged to dynamically resist motion of the car wheel in the contacting or abutting relationship when the car wheel is translating in a first direction and when the car wheel is translating in a second direction opposite to the first direction.

21. A device for slowing down and bringing to a stop rail cars comprising:

an articulated member constructed and arranged to move between a first raised position and a second retracted position;

wherein, when in the first raised position, the articulated member is constructed and arranged to receive and dynamically resist inertial motion of a car wheel the articulated member is in contact with to provide dampening to slow down and stop the rail cars over an extended distance;

wherein when in the second retracted position, the articulated member is constructed and arranged to offer no resistance to movement of the car wheel;

wherein movement between the first raised position and the second raised position is effected via a hydraulic or pneumatic ram.

22. The device according to claim 21:

wherein the articulated member includes antifriction rollers;

wherein the antifriction rollers are constructed to engage the car wheel;

wherein when the antifriction rollers engage the car wheel, rotation of the car wheel in a first direction induces rotation of the antifriction rollers in a second direction opposite to the first direction to prevent the car wheel from rolling over and overcoming the articulated member.

23. The device according to claim 21, wherein the articulated member, when in the first raised position, is constructed and arranged to be in contact with a flange of the car wheel and not a tyre of the car wheel.

24. The device according to claim 21, wherein the articulated member, when in the first raised position, is constructed and arranged to receive and dynamically resist the inertial motion of the car wheel the articulated member is in contact with when the car wheel is translating in a first direction and when the car wheel is translating in a second direction opposite to the first direction.

* * * * *